US010156123B2

(12) United States Patent
Arias et al.

(10) Patent No.: US 10,156,123 B2
(45) Date of Patent: Dec. 18, 2018

(54) INFLOW CONTROL DEVICE ADJUSTED BY ROTATION OF A COVER SLEEVE

(71) Applicant: Halliburton Energy Services, Inc., Houston, TX (US)

(72) Inventors: Uriel Arias, Carrollton, TX (US); Stephen M. Greci, Carrollton, TX (US); Onyema C. Oyeka, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 298 days.

(21) Appl. No.: 14/911,231

(22) PCT Filed: Oct. 28, 2014

(86) PCT No.: PCT/US2014/062731
§ 371 (c)(1),
(2) Date: Feb. 9, 2016

(87) PCT Pub. No.: WO2016/068889
PCT Pub. Date: May 6, 2016

(65) Prior Publication Data

US 2016/0265308 A1 Sep. 15, 2016

(51) Int. Cl.

| | |
|---|---|
| ***E21B 34/06*** | (2006.01) |
| ***E21B 43/12*** | (2006.01) |
| *E21B 33/12* | (2006.01) |
| *E21B 43/14* | (2006.01) |
| *E21B 34/00* | (2006.01) |

(52) U.S. Cl.
CPC ..... *E21B 34/06* (2013.01); *E21B 43/12* (2013.01); *E21B 33/12* (2013.01); *E21B 43/14* (2013.01); *E21B 2034/007* (2013.01)

(58) Field of Classification Search
CPC .... E21B 2034/007; E21B 33/12; E21B 34/06; E21B 43/12; E21B 43/14
See application file for complete search history.

(56) References Cited

U.S. PATENT DOCUMENTS

| | | | |
|---|---|---|---|
| 7,802,621 | B2 | 9/2010 | Richards et al. |
| 8,356,669 | B2 | 1/2013 | Holderman |
| 8,602,110 | B2 | 12/2013 | Kuo et al. |
| 8,657,016 | B2 | 2/2014 | Greci et al. |

(Continued)

OTHER PUBLICATIONS

International Search Report and Written Opinion dated Jul. 28, 2015; PCT International Application No. PCT/US2014/062731.

*Primary Examiner* — Caroline N Butcher
(74) *Attorney, Agent, or Firm* — McGuireWoods LLP

(57) ABSTRACT

An inflow control device comprising: a housing, wherein the housing comprises a receptacle and a receptacle opening; a plug, wherein the plug fits into the receptacle; and a cover sleeve, wherein the cover sleeve is positioned around a portion of the housing and comprises a cover sleeve port, wherein the cover sleeve is rotatable circumferentially around a longitudinal axis of the housing to align the cover sleeve port with the receptacle opening, and when the port and opening are aligned, the plug is positionable into the receptacle or removable from the receptacle. The inflow control device can be used in an oil, gas, or water production well, or an injection well to variably control the flow rate of a fluid flowing through the device.

23 Claims, 7 Drawing Sheets

(56) References Cited

U.S. PATENT DOCUMENTS

| | | | | |
|---|---|---|---|---|
| 2004/0112608 | A1 | 6/2004 | Jackson | |
| 2008/0169099 | A1* | 7/2008 | Pensgaard | E21B 33/138 166/285 |
| 2010/0000727 | A1 | 1/2010 | Webb et al. | |
| 2013/0075112 | A1* | 3/2013 | Franklin | E21B 34/066 166/374 |
| 2013/0277043 | A1 | 10/2013 | Hallundbaek et al. | |
| 2013/0319664 | A1 | 12/2013 | McNamee et al. | |
| 2014/0251636 | A1 | 9/2014 | Hofman et al. | |
| 2016/0003005 | A1* | 1/2016 | Pickle | E21B 34/10 166/374 |

* cited by examiner

INFLOW CONTROL DEVICE ADJUSTED BY ROTATION OF A COVER SLEEVE

TECHNICAL FIELD

Inflow control devices are used to control the flow rate of a fluid. The inflow control device can include one or more hollow or solid plugs to selectively adjust the flow rate of the fluid. The inflow control device can be used in a variety of oil and gas operations.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
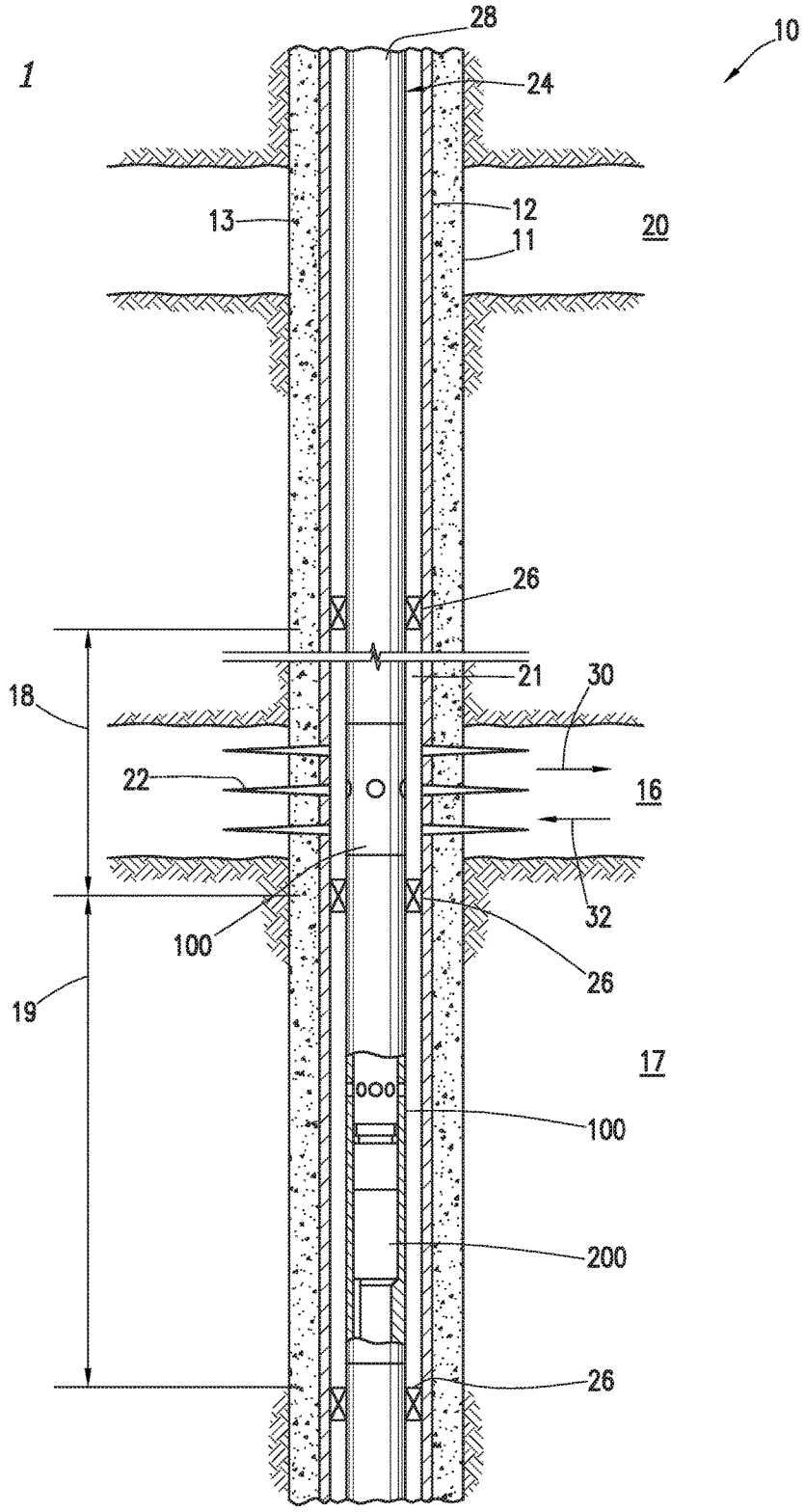
FIG. 1 is an illustration of a well system containing two inflow control devices located within two intervals in a wellbore of the well system.

Oil and gas hydrocarbons are naturally occurring in some subterranean formations. In the oil and gas industry, a subterranean formation containing oil and/or gas is referred to as a reservoir. A reservoir can be located on land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, a first zone can have a higher permeability compared to a second zone. It is often desirable to treat one or more locations within multiples zones of a formation. One or more zones of the formation can be isolated within the wellbore via the use of an isolation device, in conjunction with an isolation mandrel, to create multiple wellbore intervals. At least one wellbore interval can correspond to a particular subterranean formation zone. An isolation device can be used for zonal isolation and functions to block fluid flow within a tubular, such as a tubing string, or within an annulus. The blockage of fluid flow prevents the fluid from flowing across the isolation device in any direction and isolates the zone of interest. In this manner, completion operations, such as well treatments, fracturing, injecting, production, etc., can be performed within the zone of interest.

It should be understood that, as used herein, "first," "second," "third," etc., are arbitrarily assigned and are merely intended to differentiate between two or more zones, wellbore intervals, inflow control devices, etc., as the case can be, and does not indicate any particular orientation or sequence. Furthermore, it is to be understood that the mere use of the term "first" does not require that there be any "second," and the mere use of the term "second" does not require that there be any "third," etc.

Inflow control devices (ICD) can be used to variably restrict the flow rate of fluids flowing through the wellbore, for example in a particular wellbore interval. An ICD can include a plurality of flow passages or receptacles. The ICD can be attached to a base pipe. The base pipe can be perforated at the location of the ICD. In this manner, fluid can flow through the ICD and flow radially towards the base pipe to enter the perforations within the base pipe. The fluid can then flow into the inside of the pipe and towards a wellhead of the wellbore. Alternatively, the ICD can be operatively connected to a sliding sleeve tool. The sliding sleeve tool can be connected to a base pipe such that fluid can flow axially along a longitudinal axis of the housing or base pipe, through the ICD, and along an annulus between the outside of the base pipe and the inside of a shroud and into the sliding sleeve tool. When the sleeve of the tool is open, the fluid can flow through the sleeve and towards the wellhead.

The inflow control device can variably restrict fluid flow through the ICD via one or more plugs positioned within the receptacles of the housing. By way of example, an ICD can have 4 or more receptacles. One or more of the receptacles can include solid plugs that prevent fluid flow through those passages and one or more hollow plugs that allow fluid flow through those passages. By selecting the number of solid versus hollow plugs, one can adjust the flow rate of fluid flowing through the ICD. The inner diameter of the hollow plugs can also be varied to variably control the flow rate of the fluid flowing through the ICD.

The inflow control device can include a cover sleeve. The cover sleeve is generally shifted up or down along a longitudinal axis of the base pipe in order to expose a portion of the receptacles of the ICD. The plugs can then be inserted or removed from the receptacle within the passage, and the sleeve can be shifted back to the original position to close the passage.

There may have to be more than one type of cover sleeve assembly for an axial versus radial flowing ICD. This can lead to a more complicated system and increase costs and time. Moreover, shifting of the cover sleeve can allow for leakage issues to arise. Therefore, there is a need for inflow control devices that are easily adaptable for both radial and axial flow and provide easy and improved ways to adjust the flow rate of the fluid.

According to an embodiment, an inflow control device comprises: a housing, wherein the housing comprises a receptacle and a receptacle opening; a plug, wherein the plug fits into the receptacle; and a cover sleeve, wherein the cover sleeve is positioned around a portion of the housing and comprises a cover sleeve port, wherein the cover sleeve is rotated circumferentially around a longitudinal axis of the housing to align the cover sleeve port with the receptacle opening, and when the port and opening are aligned, the plug can be positioned into the receptacle or removed from the receptacle.

According to another embodiment, a method of controlling the flow rate of a fluid in a wellbore comprises: positioning the inflow control device within the wellbore; and flowing a fluid through the inflow control device.

According to yet another embodiment, a system for controlling the flow rate of a fluid, the system comprising: a wellbore; and the inflow control device.

Any discussion of the embodiments regarding the inflow control device or any component related to the inflow control device is intended to apply to all of the apparatus, system, and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can have a generally vertical uncased section extending downwardly from the casing 12, as well as a generally horizontal uncased section extending through the subterranean formation 20. The wellbore 11 can alternatively include only a generally vertical wellbore section, or can alternatively include only a generally horizontal wellbore section. The wellbore 11 can include a heel and a toe (not shown).

A tubing string 24 can be installed in the wellbore 11. The tubing string 24 can be secured in the wellbore 11 by setting packers 26 against a casing string 12 or an open-hole section of the wellbore 11, or by cementing the tubing string 24 in the wellbore with cement 13, etc. The tubing string 24 can include a flow passage 28 for injection or production of fluids into or from the subterranean formation 20. The well system 10 can comprise at least a first wellbore interval 18 and a second wellbore interval 19. The well system 10 can also include more than two wellbore intervals, for example, the well system 10 can further include a third wellbore interval, a fourth wellbore interval, and so on. At least one wellbore interval can correspond to a specific zone of the subterranean formation 20. For example, the subterranean formation 20 can have a first zone 16 and a second zone 17. Of course, there can be more than two zones of the formation. The well system 10 can further include one or more packers 26. The packers 26 can be used in addition to isolation devices to create the wellbore intervals and isolate each zone of the subterranean formation 20. The packers 26 can be used to prevent fluid flow between one or more wellbore intervals (e.g., between the first wellbore interval 18 and the second wellbore interval 19) via an annulus 21 located between the outside of the tubing string 24 and the inside of the casing 12 or wall of the wellbore 11. Some or all of the packers 26 can be replaced by cement-filling the annulus. The tubing string can include any other well tools 200 suitable for carrying out wellbore operations.

One or more of the wellbore intervals can include an inflow control device 100. The inflow control device 100 can be used to variably control the flow rate of a fluid entering the wellbore (shown in FIG. 1 as arrow 32), for example, during production of a reservoir fluid; or a fluid exiting the wellbore (shown in FIG. 1 as arrow 30), for example, to conduct an injection operation. The formation can include one or more fractures 22. The inflow control device 100 can also be operatively connected to a downhole tool 200 that includes a sliding sleeve.

Figure 2:
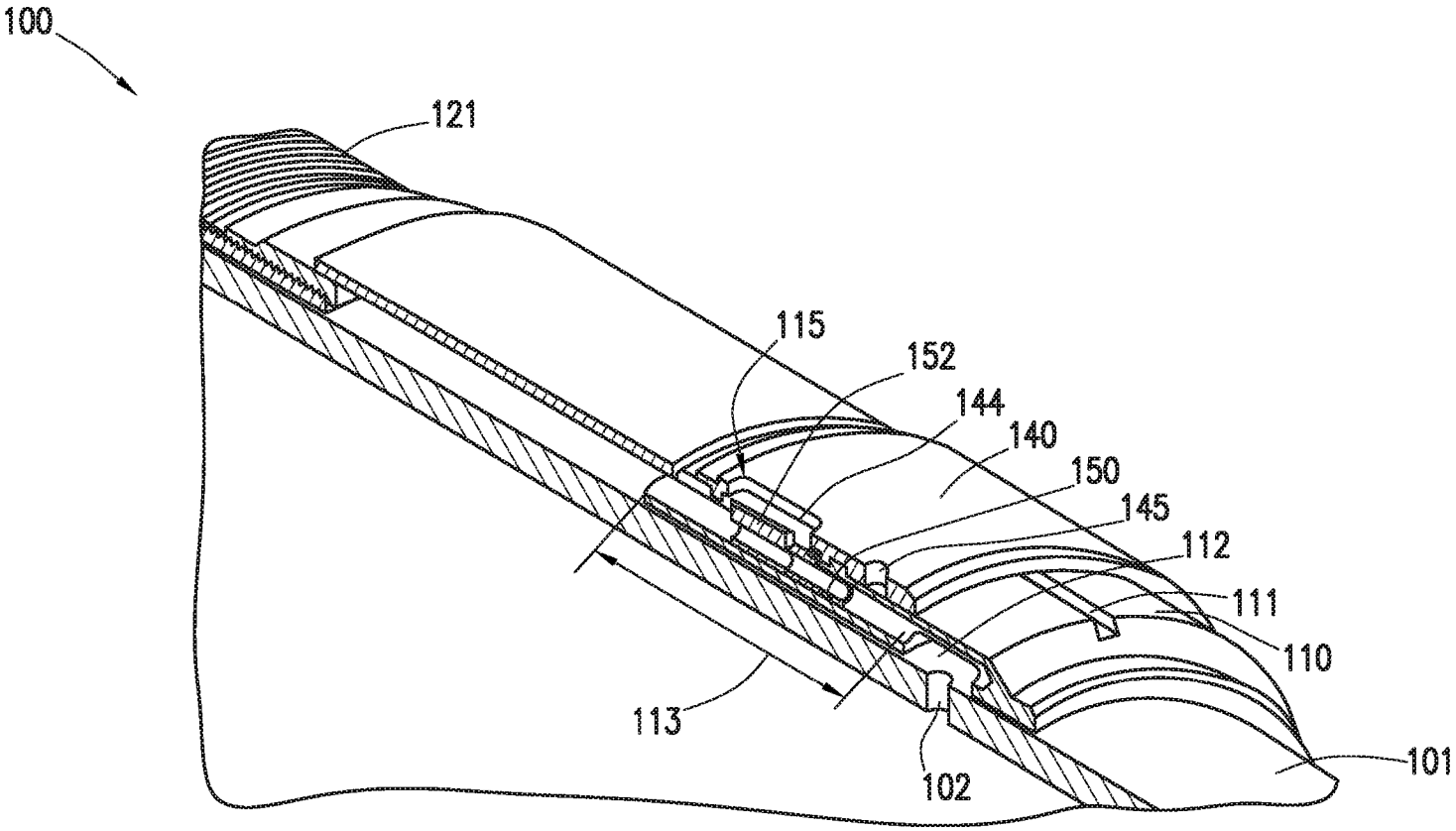
FIG. 2 is an illustration of a cover sleeve of the inflow control device according to certain embodiments.

Turning to FIG. 2, the inflow control device 100 includes a housing 110. The housing 110 can be positioned around the outside of a base pipe 101. The base pipe 101 can be the tubing string 24 or the base pipe 101 can be operatively connected to the tubing string 24 via one or more other tubular members. The base pipe 101 can include one or more perforations 102. As used herein, a "perforation" is any opening or hole, regardless of shape or size that permits fluid to flow through. A perforation can be a slot or hole or any other suitable configuration. The housing 110 can also be operatively connected to other wellbore components, such as a screen 121 of a sand screen assembly. According to certain embodiments, the housing 110 includes a housing port 112. The housing port 112 can be located adjacent to the perforation 102. As such, fluid can flow through the housing port 112 and into the inside of the base pipe 101 via the perforations 102 or from the inside of the base pipe into the housing via the perforations and housing port.

The housing 110 can also include a receptacle 113. The receptacle 113 can provide a fluid flow passage through the housing. The receptacle 113 contains a receptacle opening 115 to the outside of the housing 110. The receptacle 113 has dimensions such that a plug 150 can be fitted into the receptacle. The plug 150 can be a hollow plug or a solid plug. A hollow plug allows fluid flow through the plug and a solid plug prevents fluid flow through the plug. For example, a hollow plug can have a body and a fluid flow passage 153 through the body where a fluid can flow through the plug. By contrast, a solid plug does not have a fluid flow passage 153. The plug 150 can be made from a variety of materials, such as metals, including metal carbides, or any other suitable material including, but not limited to a polymer, composite, ceramic, etc. The plugs 150 (hollow and solid) can have an outer profile that corresponds to the dimensions of the receptacle 113 such that fluid flow through the receptacle 113 only occurs through hollow plugs 150. For example and without limitation, once a plug 150 is fitted into the receptacle 113, the plug can create a seal around the outside of the plug, for example, via one or more sealing elements 151 (not shown on FIG. 2), such as an O-ring. In this manner, fluid is prevented from flowing around the outside of the plug, and can only flow through the opening of the hollow plugs. It will be appreciated that embodiments not having such seal elements are contemplated and within the scope of the present disclosure. According to certain embodiments, the outer profile of the hollow and solid plugs are substantially the same thereby allowing for either plug to be fitted into the receptacle 113, which may reduce manufacturing costs and provide a simple design. A plug retainer 152 can then be positioned in the receptacle 113 adjacent the plugs 150. According to certain embodiments, the plug retainer 152 can be used to push the plug 150 farther into the receptacle 113 to cause the plug 150 to become sealingly engaged within the receptacle 113. The plug retainer 152 can help secure the plug 150 within the receptacle 113. The plug retainer 152 can be hollow, having a body and a fluid flow passage 153 located within the body such that fluid flow is possible through the plug retainer. The plug retainer 152 can also be made from a variety of materials, for example any suitable material that is resistant to corrosion from wellbore fluids. Each of the plug 150 and plug retainer 152 can include one or more protrusions (like a fin) for easier insertion or removal from the receptacle.

The inflow control device 100 also includes a cover sleeve 140. The cover sleeve 140 is positioned around a portion of the housing 110. The cover sleeve 140 can be positioned around the outside of the housing 110. The cover sleeve 140 can be rotated circumferentially around a longitudinal axis of the housing 110. The cover sleeve 140 can also be sealed to the housing 110 via one or more seals 143 (not shown in FIG. 2), such as an O-ring.

Figure 3B:
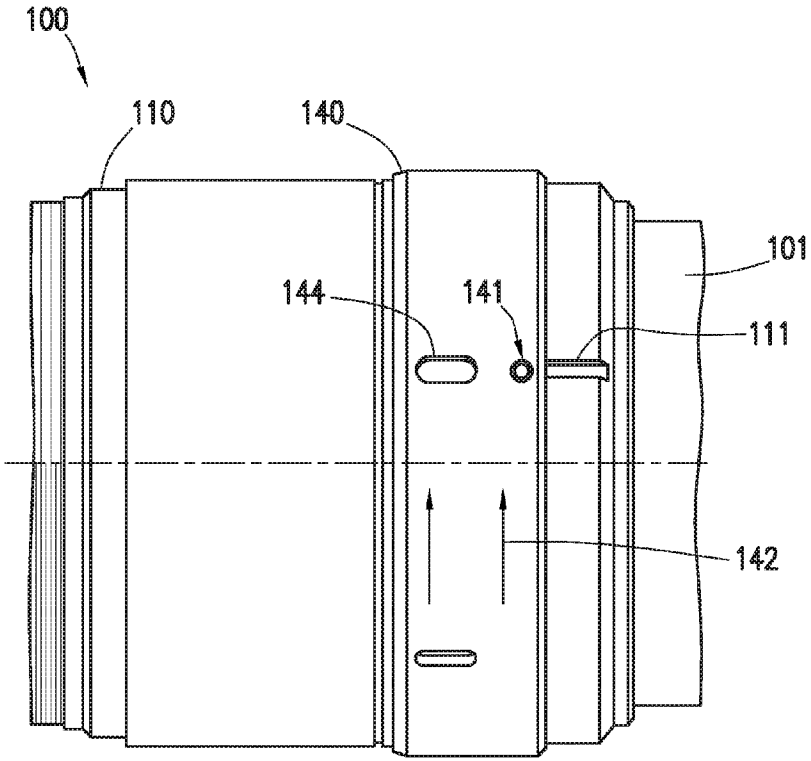
FIGS. 3A and 3B are illustrations of the inflow control device with the cover sleeve in an open and closed position, respectively.
Figure 3A:
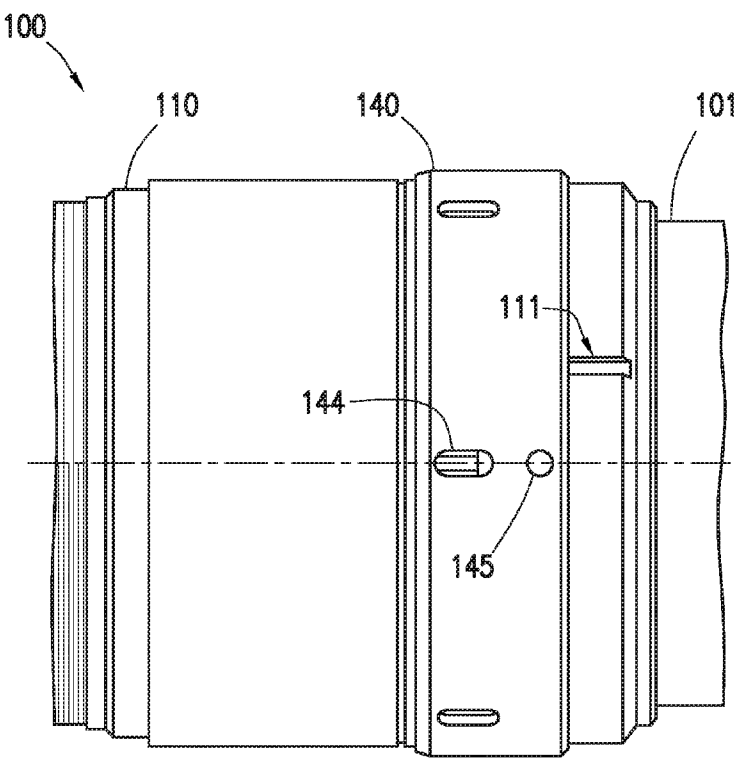

As shown in FIGS. 2-3B, the cover sleeve 140 also includes a cover sleeve port 144. The cover sleeve 140 is rotated circumferentially around a longitudinal axis of the housing 110 (shown in FIG. 3B as arrows 142) to align the cover sleeve port 144 with the opening of the housing 110. When the port and opening are aligned, as shown in FIG. 3A, the cover sleeve 140 is in the open position whereby the plug 150 and the plug retainer 152 can be inserted or removed from the receptacle 113. However, when the port and the opening are not aligned, as shown in FIG. 3B, the cover sleeve 140 is in the closed position and the plug 150 and the plug retainer 152 cannot be inserted or removed from the receptacle 113.

The cover sleeve 140 can also include one or more rotationally-locking devices 141. The rotationally-locking device 141 can substantially inhibit or prevent rotation of the cover sleeve 140 when the devices are activated, for example to maintain the cover sleeve in the open or closed position. For example, the cover sleeve 140 can include an opening that receives a set screw. The housing 110 can also include a groove 111 or a hole (not shown) that corresponds to an end of the set screw. When the screw is tightened (i.e., activated) the end of the screw can protrude into the groove or the hole and be used to create a frictional or mechanical hold to inhibit or prevent rotation. In this manner, once the plug 150 and plug retainer 152 have been fitted into the receptacle 113, the cover sleeve 140 can be closed by rotating the cover sleeve 140 and the rotationally-locking device 141 can be used to inhibit or prevent rotation of the cover sleeve 140 into the open position. It will be appreciated that the forgoing is but one way of maintaining the cover sleeve in a desired position (e.g., open, closed, etc.) and that any suitable means, technique, device(s), or any suitable combination thereof can be employed to maintain the cover sleeve in a desired position and remain within the scope of the present disclosure.

Figure 4:
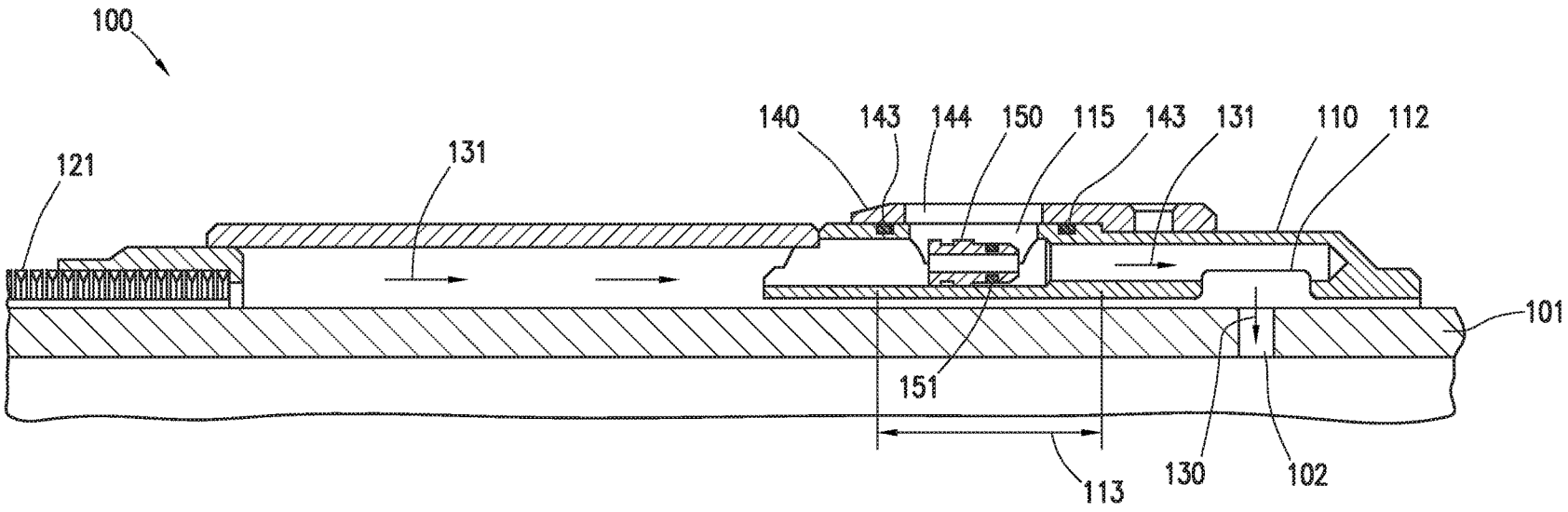
FIG. 4 is an illustration of the inflow control device containing an open plug and radial fluid flow.
Figure 5A:
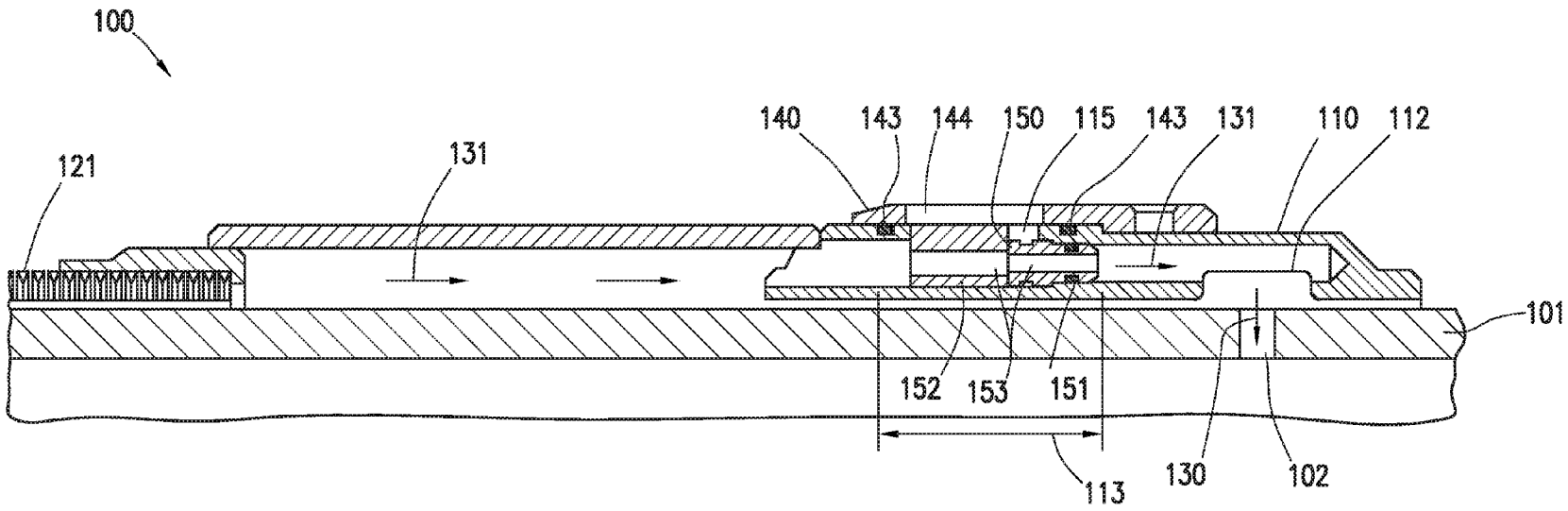
FIGS. 5A and 5B are illustrations of the inflow control device containing a plug retainer and a hollow plug and solid plug, respectively.
Figure 5B:
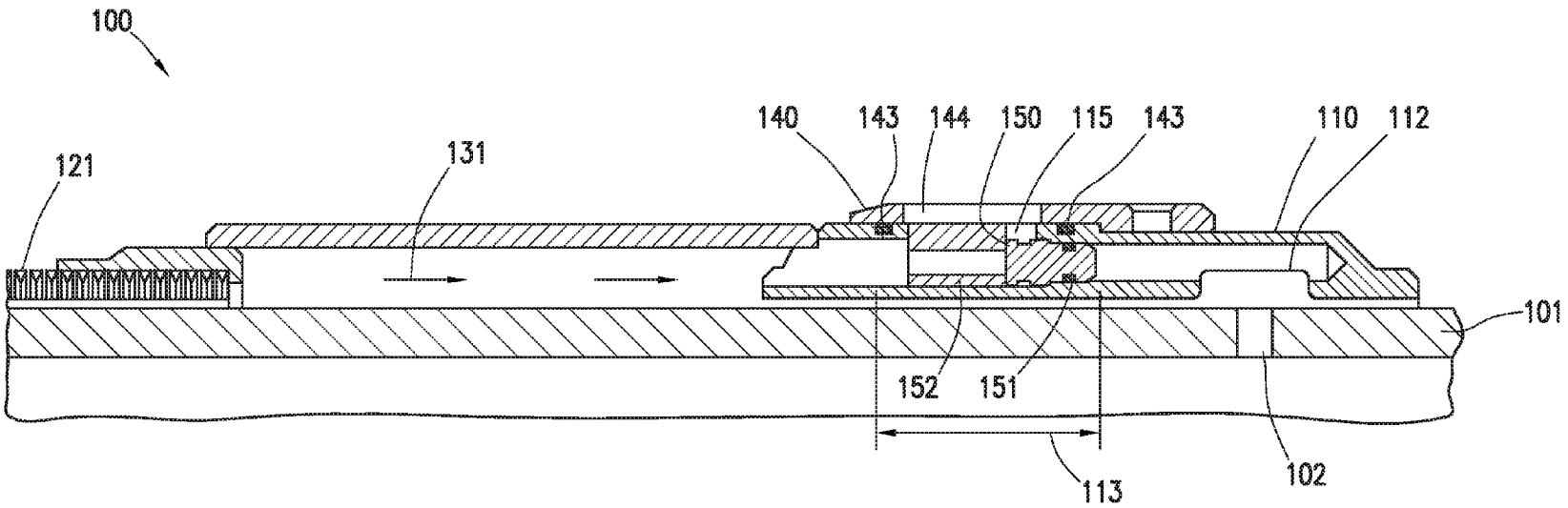

With reference to FIGS. 4-5B, when the plug 150 is hollow, as depicted in FIGS. 4 and 5A, fluid can flow into the housing 110 from the annulus 21 of the wellbore 11, for example through the screen 121 and through the open inflow control device 100, in an axial flow parallel with a longitudinal axis of the base pipe 101 (depicted in FIGS. 4-5B as arrows 131), into the receptacle 113, through the plug retainer 152 and the plug 150, into the housing port 112 in a radial direction (depicted in FIGS. 4-5B as arrow 130), through the perforations 102 and into the base pipe 101. Of course, fluid flow can also occur in the opposite direction (i.e., from the base pipe and into the wellbore annulus) along the same or similar path. However, as depicted in FIG. 5B, when the plug 150 is solid, then fluid does not flow past the plug and into the base pipe or further downhole.

Although reference is made to a singular receptacle, receptacle opening, cover sleeve port, etc., it is to be understood that the inflow control device 100 can contain two or more plug assemblies arranged circumferentially around the housing for controlling the flow rate of a fluid through the ICD. By way of example, the inflow control device 100 can contain four receptacles 113, receptacle openings, and cover sleeve ports 144. The configuration of solid and hollow plugs can be adjusted to provide the desired flow rate of fluid through that particular inflow control device 100. For example, all four of the receptacles 113 could contain hollow plugs 150 to allow for an increased flow rate through the ICD. By contrast, for a slower flow rate, only one of the receptacles 113 could contain a hollow plug 150, while the other three receptacles contained solid plugs. One of ordinary skill in the art will be able to select the desired number of hollow plugs and solid plugs configuration to provide a desired flow rate through the ICD. Yet another way to adjust the flow rate is by adjusting the inner diameter (I.D.) of the hollow plugs. The larger the I.D. of the hollow plug provides for a higher flow rate; whereas, the smaller the I.D. of the hollow plug provides for a lower the flow rate.

At least one inflow control device 100 can be positioned in at least one wellbore interval. More than one ICD can be positioned in at least one wellbore interval. There can also be one or more ICDs positioned in two or more wellbore intervals. The exact configuration of the ICDs can be the same or different. For example, in order to create balanced fluid flow from multiple subterranean formation zones, then the receptacles 113 for the ICDs associated with highly-permeable zones can be configured to have a very limited number of hollow plugs 150 within the receptacles 113, such that there is a decreased flow rate through the ICDs located in those highly-permeable zones. By contrast, other zones could have a low permeability, in which case the ICDs associated with those zones could be configured to have a majority or 100% of hollow plugs 150 to provide a higher flow rate through those ICDs. This can allow for a more balanced flow rate of fluids from multiple zones from the subterranean formation. This embodiment can be useful, for example, to help counteract the heel-toe effect in long horizontal wellbores.

Figure 6:
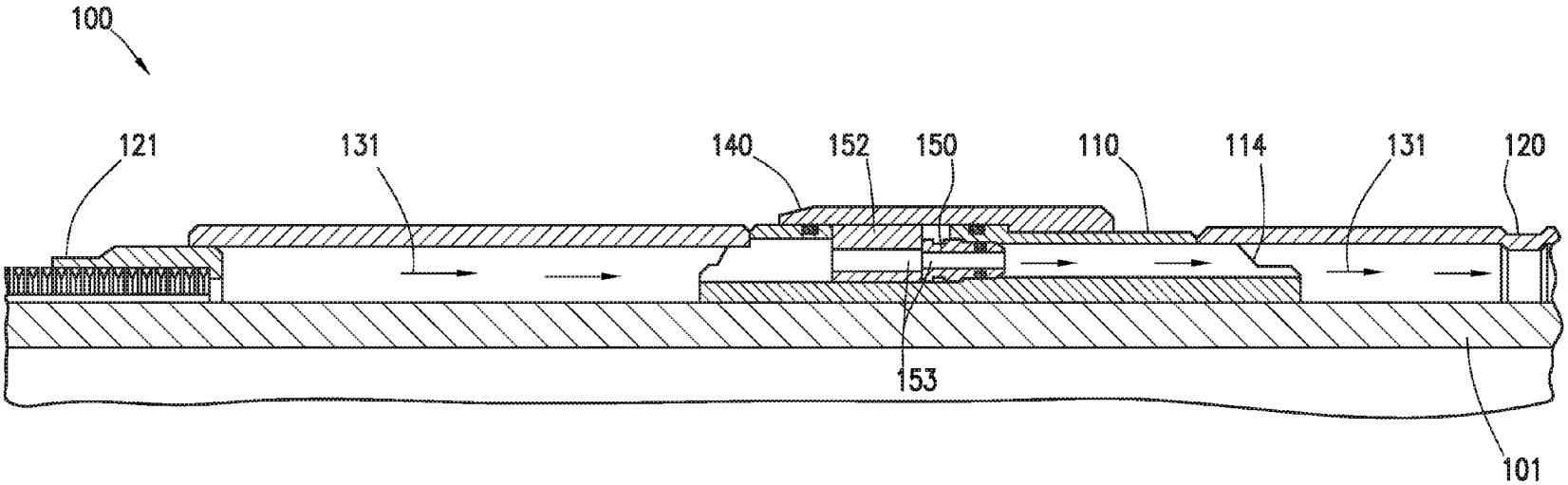
FIG. 6 is yet another illustration of the inflow control device having an axial fluid flow according to certain embodiments.

Turning to FIG. 6, the housing 110 can be easily adapted for use with a downhole tool 200 (not shown in FIG. 6, but shown in FIG. 1). The tool 200 can include one or more sliding sleeves for selectively permitting and preventing fluid flow into the base pipe 101. The housing 110 can be operatively connected to the tool 200 via a shroud 120. The housing 110 can be adapted by providing a second open end 114 of the housing. In this manner, fluid can enter the housing 110 and flow in the axial direction 131 through the hollow plug 150, past the second open end 114 of the housing, through an annulus between the outside of the base pipe 101 and the shroud 120, and into the tool 200. The tool 200 can be used to allow or prevent fluid flow towards the wellhead by being in an open position or closed position. The inflow control device 100 allows the flow rate of the fluid travelling through the ICD and into the tool 200 to be controlled. Of course, fluid flow can also occur in the opposite direction (i.e., from the base pipe, through the tool, and into the wellbore annulus). It should be understood that for the embodiments depicted in FIG. 6 at least one of the plugs 150 of the inflow control device 100 is a hollow plug to allow the fluid to flow to the tool 200 or from the tool.

Some of the advantages of the new ICD include: easily converted between axial and radial fluid flow; plugs are easily removed and installed within the housing; and axial rotation of the cover sleeve inhibits or prevents leakage issues. It should be appreciated by those skilled in the art that the outer profile of the plugs can allow for easy and quick adjustability of the inflow control device 100. For example, the plugs and receptacles can be used regardless of whether axial or radial flow is desired. In this manner, the ICD can be assembled at the factory and configured for either axial flow to be used with a tool or radial flow. The ICD can be shipped to a well site with a variety of varied I.D. hollow and solid plugs 150 located within the one or more receptacles 113. An operator at the well site can then determine the desired flow rate of fluid through a particular inflow control device 100 based on the specifics of the wellbore and formation.

The methods include providing the inflow control device. The methods further include rotating the cover sleeve 140 to an open position, wherein the cover sleeve port 144 is aligned with the receptacle opening 115 in the open position to provide access to the plug retainers 152 and plugs 150. A tool, such as pliers, can then be used to remove the plug retainer 152 and the plug 150. A desired number of hollow plugs and solid plugs and their corresponding plug retainers 152 can be positioned into the receptacles to achieve a desired configuration. The cover sleeve 140 can then be rotated back to a closed position, wherein the cover sleeve port and receptacle opening are not aligned, and the rotationally-locking device 141 can be secured to keep the cover sleeve 140 in the closed position. The properly configured ICD can then be positioned or run into the wellbore for operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing.

Therefore, the present system is well adapted to attain the ends and advantages mentioned as well as those that are inherent therein. The particular embodiments disclosed above are illustrative only, as the principles of the present disclosure can be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above can be altered or modified and all such variations are considered within the scope and spirit of the principles of the present disclosure.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that can be incorporated herein by reference, the definitions that are consistent with this specification should be adopted.

What is claimed is:

1. A system for controlling the flow rate of a fluid, the system comprising:

a wellbore; and an inflow control device positioned in the wellbore, wherein the inflow control device comprises:

(A) a housing, wherein the housing comprises a receptacle and a receptacle opening;

(B) a plug, wherein the plug fits into the receptacle; and (C) a cover sleeve, wherein the cover sleeve is positioned around a portion of the housing and comprises a cover sleeve port, wherein the cover sleeve is rotatable circumferentially around a longitudinal axis of the housing to align the cover sleeve port with the receptacle opening, and when the port and opening are aligned, the plug is positionable within the receptacle or removable from the receptacle.

2. The system according to claim 1, the receptacle provides a fluid flow passage through the housing.

3. The system according to claim 1, wherein the cover sleeve comprises two ends that sealingly engage the outside of the housing.

4. The system according to claim 1, wherein the cover sleeve further comprises one or more rotationally-locking and axial-locking devices, wherein the rotationally-locking and axial-locking devices substantially inhibit or prevent rotation and axial movement of the cover sleeve when the locking devices are activated.

5. The system according to claim 1, wherein the plug is a hollow plug or a solid plug.

6. The system according to claim 1, wherein the plug is hollow plug, wherein the plug has an outer profile that substantially corresponds to the dimensions of the receptacle such that fluid flow through the receptacle only occurs through the hollow plug.

7. The system according to claim 1, further comprising a plug retainer located adjacent to the plug, wherein the plug retainer causes the plug to become sealingly engaged within the receptacle.

8. The system according to claim 7, wherein the plug is a hollow plug, wherein the housing is positioned around the outside of a base pipe having one or more perforations, and wherein fluid flows into the housing from the wellbore in an axial direction along a longitudinal axis of the base pipe, into the receptacle, through the plug retainer and the hollow plug, and into the inside of the base pipe in a radial direction via the one or more perforations.

9. The system according to claim 7, wherein the plug is a solid plug; wherein the housing is positioned around the outside of a base pipe having one or more perforations, and wherein fluid flows into the housing from the wellbore in an axial direction along a longitudinal axis of the base pipe, into the receptacle, through the plug retainer and does not flow past the solid plug.

10. The system according to claim 1, wherein the housing is operatively connected to a tool via a shroud.

11. The system according to claim 10, wherein the housing is positioned around the outside of a base pipe, and wherein when the plug is a hollow plug, fluid flows into the housing from the wellbore in an axial direction along a longitudinal axis of the base pipe, into the receptacle, through the plug retainer and the hollow plug, past a second open end of the housing, through an annulus between the outside of the base pipe and the inside of the shroud, and into the tool.

12. The system according to claim 1, wherein the inflow control device comprises two or more receptacles, receptacle openings, plugs, and cover sleeve ports.

13. The system according to claim 12, wherein the two or more plugs are selected to provide the desired flow rate of fluid through the inflow control device.

14. The system according to claim 1, wherein the plug is a hollow plug comprising an inner diameter, wherein the inner diameter of the hollow plug is selected to provide the desired flow rate of fluid through the inflow control device.

15. A method of controlling the flow rate of a fluid in a wellbore comprising:

providing an inflow control device, wherein the inflow control device comprises:

(A) a housing, wherein the housing comprises one or more receptacles and one or more receptacle openings;

(B) one or more plugs, wherein the plugs fits into the receptacles; and (C) a cover sleeve, wherein the cover sleeve is positioned around a portion of the housing and comprises a cover sleeve port, wherein the cover sleeve is rotatable circumferentially around a longitudinal axis of the housing to align the cover sleeve port with the receptacle opening in an open position, and when the port and opening are aligned in the open position, the plug is positionable into the receptacle or removable from the receptacle;

rotating the cover sleeve to the open position;

positioning a plug into the receptacle or removing a plug from the receptacle when the cover sleeve is in the open position;

rotating the cover sleeve to a closed position, wherein the cover sleeve port is not aligned with the receptacle opening in the closed position;

positioning the inflow control device within the wellbore; and flowing a fluid through the inflow control device.

16. The method according to claim 15, wherein the housing is positioned around the outside of a base pipe having one or more perforations, and wherein the one or more plugs are hollow and fluid flows into the housing from the wellbore in an axial direction parallel to a longitudinal axis of the base pipe, into the receptacle, through a plug retainer positioned adjacent to the plug within the receptacle, through the hollow plug, and into the base pipe in a radial direction via the one or more perforations.

17. The method according to claim 15, wherein the housing is positioned around the outside of a base pipe having one or more perforations, and wherein the one or more plugs are solid and fluid flows into the housing from the wellbore in an axial direction along a longitudinal axis of the base pipe, into the receptacle, through a plug retainer positioned adjacent to the plug within the receptacle, and does not flow past the solid plug.

18. The method according to claim 15, wherein the housing is operatively connected to a tool via a shroud.

19. The method according to claim 18, wherein the housing is positioned around the outside of a base pipe, and wherein the one or more plugs are hollow and fluid flows into the housing from the wellbore in an axial direction along a longitudinal axis of the base pipe, into the receptacle, through a plug retainer positioned adjacent to the plug within the receptacle, through the hollow plug, past a second open end of the housing, through an annulus between the outside of the base pipe and the inside of the shroud, and into the tool.

20. The method according to claim 15, wherein the one or more plugs are selected to provide the desired flow rate of fluid through the inflow control device.

21. An inflow control device comprising:

a housing, wherein the housing comprises a receptacle and a receptacle opening;

a plug, wherein the plug fits into the receptacle; and a cover sleeve, wherein the cover sleeve is positioned around a portion of the housing and comprises a cover sleeve port, wherein the cover sleeve is rotatable circumferentially around a longitudinal axis of the housing to align the cover sleeve port with the receptacle opening, and when the port and opening are aligned, the plug is positionable into the receptacle or removable from the receptacle.

22. The device according to claim 21, wherein the inflow control device comprises two or more receptacles, receptacle openings, plugs, and cover sleeve ports.

23. The device according to claim 22, wherein the two or more plugs are selected to provide the desired flow rate of fluid through the inflow control device.

* * * * *